US007975463B2

(12) United States Patent
Cristofani et al.

(10) Patent No.: US 7,975,463 B2
(45) Date of Patent: Jul. 12, 2011

(54) METAL CORD AND PROCESS FOR MANUFACTURING A METAL CORD

(75) Inventors: Fabrizio Cristofani, Figline Valdarno (IT); Luca Cirilli, Figline Valdarno (IT)

(73) Assignee: Pirelli Tyre S.p.A., Milan (IT)

( * ) Notice: Subject to any disclaimer, the term of this patent is extended or adjusted under 35 U.S.C. 154(b) by 45 days.

(21) Appl. No.: 12/226,975

(22) PCT Filed: May 10, 2006

(86) PCT No.: PCT/EP2006/004353
§ 371 (c)(1),
(2), (4) Date: Nov. 3, 2008

(87) PCT Pub. No.: WO2007/128335
PCT Pub. Date: Nov. 15, 2007

(65) Prior Publication Data

US 2009/0176119 A1 Jul. 9, 2009

(51) Int. Cl.
*D02G 3/02* (2006.01)

(52) U.S. Cl. ..... 57/311

(58) Field of Classification Search ..... 57/311
See application file for complete search history.

(56) References Cited

U.S. PATENT DOCUMENTS

| | | | | |
|---|---|---|---|---|
| 2,230,272 | A | 2/1941 | Slayter | |
| 2,729,030 | A | 1/1956 | Slayter | |
| 4,258,543 | A | 3/1981 | Canevari et al. | |
| 4,276,682 | A | 7/1981 | Ruber et al. | |
| 4,604,861 | A * | 8/1986 | Matsuura et al. | 57/9 |
| 4,891,493 | A | 1/1990 | Sato et al. | |
| 5,020,312 | A | 6/1991 | Watakabe | |
| 5,213,652 | A | 5/1993 | Katoh et al. | |
| 5,287,691 | A | 2/1994 | Okamoto et al. | |
| 5,319,915 | A | 6/1994 | Kobayashi et al. | |
| 5,581,990 | A | 12/1996 | Van Giel et al. | |
| 5,584,169 | A | 12/1996 | Ikehara | |
| 5,707,467 | A | 1/1998 | Matsumaru et al. | |
| 5,722,226 | A | 3/1998 | Matsumaru | |
| 6,016,647 | A * | 1/2000 | Kawatani et al. | 57/9 |
| 6,446,423 | B1 | 9/2002 | Noferi | |
| 6,698,179 | B2 | 3/2004 | Noferi | |
| 6,959,745 | B2 * | 11/2005 | Miyazaki et al. | 152/527 |
| 2002/0038538 | A1 | 4/2002 | Noferi | |
| 2003/0046919 | A1 | 3/2003 | Noferi | |
| 2006/0065341 | A1 * | 3/2006 | Sarashi | 152/451 |

FOREIGN PATENT DOCUMENTS

| | | |
|---|---|---|
| EP | 0168857 | 1/1986 |
| EP | 0791682 | 8/1997 |

(Continued)

*Primary Examiner* — Shaun R Hurley
(74) *Attorney, Agent, or Firm* — Finnegan, Henderson, Farabow, Garrett & Dunner, L.L.P.

(57) ABSTRACT

A metal cord includes at least one preformed elementary metal wire. The metal cord has an elongation at break, measured on the bare cord, higher than or equal to 3%, preferably 4% to 6%; an elongation at break, measured on the rubberized and vulcanized cord, which differs in an amount not higher than or equal to 15%, preferably 2% to 10% with respect to the elongation at break measured on the bare cord; a part load elongation, measured on the bare cord, higher than or equal to 0.4%, preferably 0.5% to 1.5%; a part load elongation, measured on the rubberized and vulcanized cord, which differs in an amount not higher than or equal to 15%, preferably 0.5% to 10%, with respect to the part load elongation measured on the bare cord.

29 Claims, 5 Drawing Sheets

FOREIGN PATENT DOCUMENTS

| | | |
|---|---|---|
| FR | 1568875 | 5/1969 |
| JP | 02-307994 | 12/1990 |
| WO | WO 95/16816 | 6/1995 |
| WO | WO 99/28547 | 6/1999 |

* cited by examiner

METAL CORD AND PROCESS FOR MANUFACTURING A METAL CORD

CROSS REFERENCE TO RELATED APPLICATION

This application is a national phase application based on PCT/EP2006/004353, filed May 10, 2006, the content of which is incorporated herein by reference.

BACKGROUND OF THE INVENTION

1. Field of the Invention

This invention relates to a metal cord and to a process for manufacturing a metal cord.

More in particular, the present invention relates to a metal cord, usually used as a reinforcing element in elastomeric manufactured articles, comprising at least one preformed elementary metal wire.

Moreover, the present invention also relates to a process for manufacturing a metal cord.

Furthermore, the present invention also relates to an apparatus for manufacturing a metal cord.

2. Description of the Related Art

The above disclosed metal cord may be employed to produce reinforced elastomeric manufactured articles such as, for example, tires, pipes for high pressure fluids, belts, belt conveyors, and the like.

As it is known, the metal cords usually employed to reinforce elastomeric manufactured articles are generally made of several elementary metal wires twisted along an axis which coincides with the longitudinal development of the cords themselves.

Said metal cords, especially when employed in the manufacturing of tires, are generally required to be provided with high mechanical resistance and to allow a good physico-chemical adhesion with the elastomeric material in which they are embedded, as well as a good penetration of said elastomeric material in the space between the adjacent elementary metal wires of said metal cords.

In fact, it is known that, in order to avoid the risk of the metal cords undergoing undesired corrosion phenomena once inside the reinforced elastomeric manufactured article, it is very important that the elementary metal wires forming the metal cords are entirely coated, for their entire superficial development, by said elastomeric material.

This result, which is more difficult to be achieved when more complex metal cords are considered, is not easily achieved even when dealing with metal cords formed by a low number of elementary metal wires.

In fact, in order to confer the required geometric and structural stability to the metal cords, the elementary metal wires forming said metal cords are compacted, i.e. positioned intimately in contact with one another, leading to the formation of one or more closed cavities inside said metal cords which extend along the longitudinal development of the same.

These cavities are closed and, consequently, cannot be reached by the elastomeric material during the normal rubberizing phases of the metal cord and, as a consequence, corrosion may develop inside said closed cavities and propagate along the elementary metal wires forming the same.

As a consequence, this means, for example, that owing to cuts in the reinforced elastomeric manufactured product, humidity and/or external agents may penetrate into said closed cavities inevitably starting a rapid process of corrosion of the elementary metal wires, thus severely compromising the structural resistance of the metal cords themselves and, consequently, of the reinforced elastomeric manufactured product.

Furthermore, the presence of said closed cavities which cannot be reached by the elastomeric material involves a reduced adhesion of the metal wires to the elastomeric material which may cause an undesired tendency of the metal wires to separate from the same.

An additional disadvantage due to insufficient rubberizing of the metal wires, caused by the presence of said closed cavities, is the development of fretting of the metal wires in contact with one another. This generates an inevitable decrease of resistance to fatigue of the metal wires and, consequently, of the metal cords.

Attempt have been made in the art to overcome the above reported problems.

For example, the use of the so-called "open" cords has been disclosed. In said "open" cords the metal wires (generally from three to five) are loosely associated so that they are at a certain distance from one another and this distance is maintained during the entire rubberizing phase, for example, by keeping a low traction load (usually not exceeding five kilograms) applied to the cord.

Cords of the type above disclosed, namely the so-called "open" cords, are described, for example, in U.S. Pat. No. 4,258,543 in the name of the Applicant. The cords therein disclosed, are said to allow an excellent penetration of the elastomeric material between the adjacent metal wires forming the cords.

International Patent Application WO 95/16816 relates to a steel cord comprising steel filaments wherein at least one of said steel filaments has been polygonally preformed. The abovementioned steel cord is said to have a full rubber penetration and a low part load elongation (PLE).

International Patent Application WO 99/28547 relates to a steel cord comprising one or more steel filaments wherein at least one of said steel filaments is provided with a first crimp in one plane and a second crimp in a plane substantially different from the plane of the first crimp. The abovementioned cords are said to have an increased rubber penetration or an increased elongation at break.

U.S. Pat. No. 6,698,179, in the name of the Applicant, relates to a process for manufacturing a metal cord including the steps of permanently deforming at least one wire using a substantially sinusoidal deformation lying in a plane and stranding the at least one wire together with one or more other wires by twisting the wires around a longitudinal axis of the metal cords, as well as to a metal cord so obtained. The abovementioned metal cord is said to have a good rubber penetration as well as an improved elongation at break.

However, the metal cords above disclosed may show some drawbacks.

For example, in the case of the so called "open" cords, the tension to which they are subjected before they reach the rubberizing device, may cause the compacting of the wires one against the other, thus hindering the elastomeric material from penetrating between the adjacent metal wires of the cords. Consequently, although being endowed with a high part load elongation (PLE), i.e. a high elongation to low load (lower than or equal to 50 N), said cords may not allow a good elastomeric material penetration so causing a corrosion of the metal wires, and severely compromising the structural resistance of both the cords and of the reinforced elastomeric manufactured articles containing the same.

On the other end, the metal cords of the prior art such as, for example, those disclosed in International Patent Applications WO 95/16816, in WO 99/28547, or in U.S. Pat. No. 6,698,179 above reported, although being endowed with high elongation at break as well as a good elastomeric material penetration, may show a low part load elongation (PLE). Said low part load elongation (PLE) may cause problems during the manufacturing of the reinforced elastomeric manufactured articles comprising the same, in particular when used in tires manufacturing where remarkable elongations of the metal cords are required during the various manufacturing steps.

Moreover, the Applicant has noticed that, after the metal cords are rubberized and vulcanized, both the elongation at break and the part load elongation (PLE) are significantly decreased.

SUMMARY OF THE INVENTION

The Applicant has now found a metal cord comprising one or more elementary metal wires, provided with both a high elongation at break and a high part load elongation (PLE), said characteristics being maintained substantially unchanged even after the metal cord has been rubberized and vulcanized. Moreover, said metal cord shows an improved elastomeric material penetration between the adjacent elementary metal wires forming said metal cord.

According to a first aspect, the present invention relates to a metal cord comprising at least one preformed elementary metal wire, said metal cord having:

- an elongation at break, measured on the bare cord, higher than or equal to 3%, preferably of from 4% to 6%;
- an elongation at break, measured on the rubberized and vulcanized cord, which differs of an amount not higher than or equal to 15%, preferably of from 2% to 10% with respect to the elongation at break measured on the bare cord;
- a part load elongation (PLE), measured on the bare cord, higher than or equal to 0.4%, preferably of from 0.5% to 1.5%;
- a part load elongation (PLE), measured on the rubberized and vulcanized cord, which differs of an amount not higher than or equal to 15%, preferably of from 0.5% to 10%, with respect to the part load elongation (PLE) measured on the bare cord.

Said elongation at break and said part load elongation (PLE) are measured according to method BISFA-95 (method E6 and method E7, respectively) (1995). Further details about said measurements will be given in the examples reported hereinafter.

According to one preferred embodiment, said metal cord consists of a plurality of elementary preformed metal wires. Alternatively, said metal cord has at least one preformed elementary metal wire, while the remaining elementary metal wires forming said metal cord are of the non-preformed type. Prior to undergoing a given preforming action, the elementary metal wires have a straight configuration.

For the aim of the present description and of the claims which follow, with the term "preformed" it is meant that the elementary metal wire is subjected along its longitudinal development, at positions substantially regularly spaced, to a deformation by applying a transverse force above the elastic threshold of the material forming said elementary metal wire, so that the deformation remains when the applied force is removed.

According to one preferred embodiment, said elementary metal wire is firstly preformed so that it assumes substantially sinusoidal undulations; secondly, said firstly preformed elementary metal wire is helicoidally preformed, along its longitudinal axis, so that it assumes a helical wave-shaped configuration (hereinafter referred also to as "double-preformed elementary metal wire"). The result of said double preforming is an elementary metal wire tri-dimensionally preformed.

According to a preferred embodiment, said sinusoidal undulations have a wavelength (or pitch) of from 1.0 mm to 15 mm, more preferably of from 2.0 mm to 8.0 mm.

According to a further preferred embodiment, said sinusoidal undulations have a wave amplitude of from 0.10 mm to 1.0 mm, more preferably of from 0.20 mm to 0.50 mm.

The wavelength and wave amplitude ranges referred to above may be measured directly on the non-rubberized elementary metal wire before it is inserted into the elastomeric material which will be subsequently vulcanized. Advantageously, the measurement of said parameters may be performed on the elementary metal wire by using a magnifying lens and a graduated scale (for example a graduated ruler). In the case where a vulcanized reinforced elastomeric manufactured article has to be analysed, it is necessary to remove the elastomeric material therefrom by using solvents, for example by treating it with dichlorobenzene, at a temperature of at least 100° C., preferably of 140° C., for at least 12 hours.

According to one preferred embodiment, said elementary metal wire has a diameter (D) of from 0.10 mm to 0.50 mm, preferably of from 0.12 mm to 0.40 mm.

According to one preferred embodiment, said elementary metal wire is made of steel. In the case where the diameter of the elementary metal wire is of from 0.10 mm to 0.50 mm, the breaking strength of a standard NT (normal tensile) steel ranges between about 2,600 N/mm$^2$ (or 2,600 MPa—MegaPascal) and about 3,200 N/mm$^2$, the breaking strength of a HT (High Tensile) steel ranges between about 3,000 N/mm$^2$ and about 3,600 N/mm$^2$, the breaking strength of a SHT (Super High Tensile) steel ranges between about 3,300 N/mm$^2$ and about 3,900 N/mm$^2$, the breaking strength of a UHT (Ultra High Tensile) steel ranges between about 3,600 N/mm$^2$ and about 4,200 N/mm$^2$. Said breaking strength values depend in particular on the quantity of carbon contained in the steel. Preferably, the above disclosed HT, SHT and UHT elementary metal wire type are made of steel having a very high carbon content, usually greater than 0.9%).

Generally, said elementary metal wire is provided with a brass coating (Cu of between 60% and 75% by weight, Zn of between 40% and 25% by weight), having a thickness of between 0.10 μm and 0.50 μm. Said coating ensures better adhesion of the elementary metal wire to the rubberizing compound and provides for protection against corrosion of the metal, both during production of the reinforced elastomeric manufactured articles and during use thereof. Should it be necessary to ensure a greater degree of protection against corrosion, said elementary metal wire may be advantageously provided with an anti-corrosive coating other than brass, able to ensure a greater corrosion resistance, such as, for example, a coating based on zinc, zinc/manganese (ZnMn) alloys, zinc/cobalt (ZnCo) alloys or zinc/cobalt/manganese (ZnCoMn) alloys.

According to one preferred embodiment, said metal cord has a structure of the type n×D, wherein n is the number of elementary metal wires forming the cord and D is the diameter of each elementary metal wire. Preferably n ranges of from 2 to 6. Particularly preferred is n equal to 5.

Preferred metal cord constructions are, for example: 2× (i.e. two elementary metal wires twisted together), 3×, 4×, 5×, 6×, 2+1 (i.e. one strand of two metal wires and one strand of one metal wires, said two strands being twisted together), 2+2, 3+2, 1+4.

According to one preferred embodiment, said metal cord has a stranding pitch of from 2.5 mm to 25 mm, more preferably of from 6 mm to 18 mm.

According to one preferred embodiment, said metal cord has the following characteristics:

a gap area which fulfills the following equation:

$$\text{Gap Area} \geqq \pi D^2/4$$

wherein D is the elementary metal wire diameter;

the sum of the distances between each couple of adjacent elementary metal wires in a cross-section ($\Sigma s_n$) which fulfills the following equation:

$$\Sigma s_n \geqq D/2$$

wherein n is the number of the elementary metal wires, D is the elementary metal wire diameter;

said characteristics being maintained along the entire longitudinal development of the metal cord.

For the aim of the present description and of the claims which follow, with the expression "Gap Area" it is intended the area, in a cord cross-section, defined by segments connected together to form a polygon, each of said segments having its extremity on the outer circumferences of a couple of adjacent elementary metal wires.

For the aim of the present description and of the claims which follows, with the expression "the distance between each couple of adjacent elementary metal wires", it is intended the distance calculated as follows:

$$s = l - (r + r')$$

wherein l is the distance between the centres of two adjacent elementary metal wires in a cross-section, r and r' are the radius of each adjacent elementary metal wire in a cross-section. Preferably, the radius r and r' have the same value.

According to a further aspect, the present invention relates to a process for manufacturing a metal cord comprising the steps of:

(a) permanently deforming at least one elementary metal wire according to a substantially sinusoidal deformation lying in a plane obtaining a preformed metal wire;

(b) permanently deforming the preformed elementary metal wire obtained in step (a) in a helicolidal way along its longitudinal axis, so obtaining a double-preformed elementary metal wire;

(c) stranding the at least one double-preformed elementary metal wire obtained in step (b) with at least one additional elementary metal wire by twisting, so obtaining the metal cord.

The preformed metal wire obtained according to step (a) and step (b) is substantially devoid of sharp edges and/or discontinuities in curvature along its longitudinal development. Said feature is particularly advantageous since, the absence of said sharp edges/corners, results in a favourable increasing of the breaking load of the elementary metal wire.

According to a further aspect, the present invention also relates to an apparatus for manufacturing a metal cord comprising:

at least one rotor engaged to a supporting structure and rotatable according to a rotation axis;

feeding devices to feed a plurality of elementary metal wires from respective feeding spools, said elementary metal wires being driven onto the rotor according to a stranding path with end sections coinciding with the rotation axis of said rotor and with a central section spaced from said rotation axis;

at least one first preforming device, positioned in a section upstream with respect to the first end section of the stranding path, operating on one of said elementary metal wires, said at least one first preforming device providing said elementary metal wire with a substantially sinusoidal permanent deformation;

at least one second preforming device, positioned after said first preforming device in a section upstream with respect to the first end section of the stranding path, operating on the same elementary metal wire, said at least one second preforming device providing said elementary metal wire with a substantially helicoidal permanent deformation along its longitudinal axis.

According to one preferred embodiment, said apparatus comprises at least one first preforming device for each elementary metal wire of the metal cord.

According to a further preferred embodiment, said at least one first preforming device comprises a first and a second pulley, each pulley having a plurality of circumferentially arranged pins, said pulleys being positioned at a distance so that during rotation the pins of the first and the second pulley interpenetrate so as to induce a substantially sinusoidal deformation without sharp edges on a wire passing through the space between the pins of the first pulley and the corresponding pins of the second pulley.

According to one preferred embodiment, said at least one second preforming device comprises a pulley and a rotating pin, said rotating pin being positioned between said pulley and the first end section of the stranding path in such a way that, the internal angle ($\alpha$) formed by the rotating pin inlet elementary metal wire and the rotating pin outlet elementary metal wire is lower than or equal to 180°, preferably of from 45° to 90°. Preferably, said rotating pin may have at least one groove, more preferably a plurality of parallel grooves. Preferably, saids pulley is an adjustable pulley.

According to one preferred embodiment, said apparatus comprises at least one second preforming device for each elementary metal wire.

BRIEF DESCRIPTION OF THE DRAWINGS

Further features and advantages of the present invention will be better explained by the following detailed description of some preferred embodiments thereof, reproduced with reference to the accompanying drawings, wherein.

DETAILED DESCRIPTION OF THE INVENTION

Figure 1:
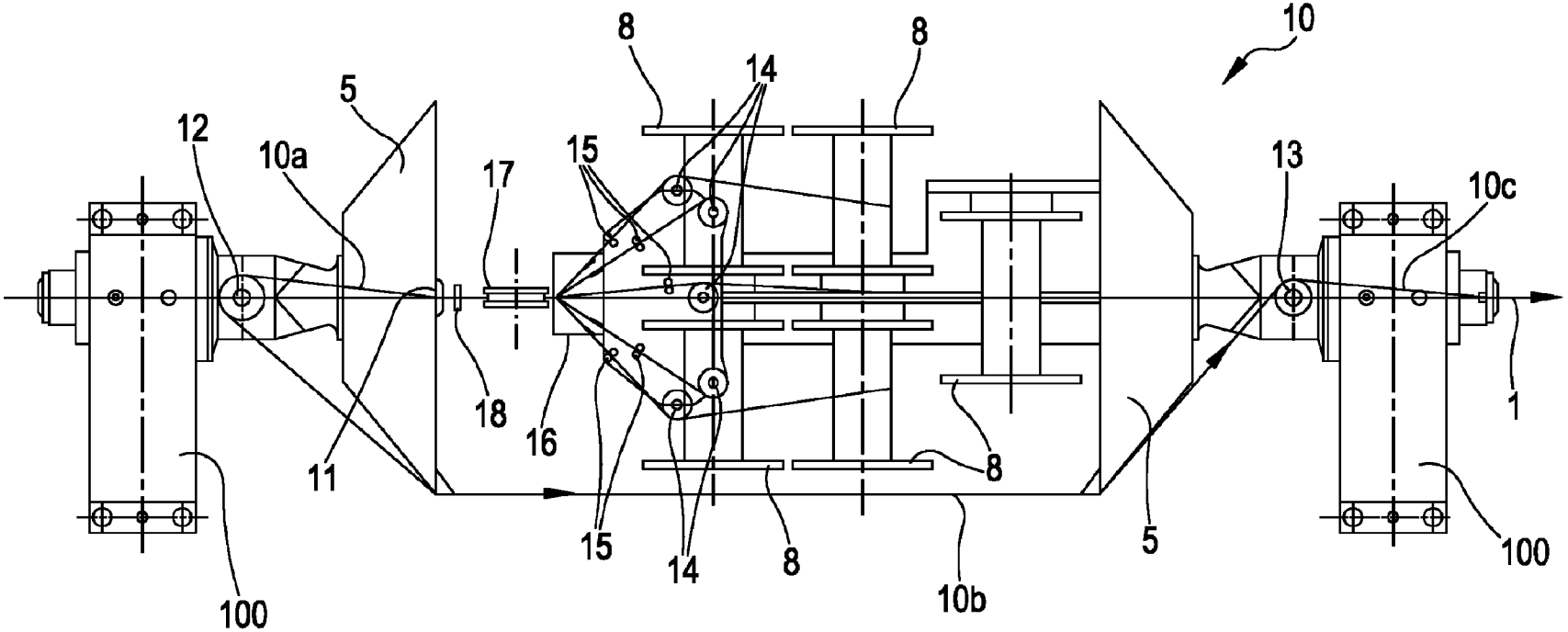
FIG. 1 shows, in a lateral view, an apparatus according to the present invention.

With reference to FIG. 1, reference sign 1 indicates the metal cord 1. Said metal cord 1, as disclosed above, comprises several elementary metal wires (not illustrated in FIG. 1), preferably made of steel, and more preferably provided with a brass coating, having a diameter (D) of from 0.10 mm to 0.50 mm, preferably of from 0.12 mm to 0.40 mm twisted around the longitudinal axis of the metal cord.

The specific features and constructive features of the metal cord 1 according to the invention will be better understood by means of the following description, both as regards the apparatus used and the procedure for its manufacturing.

FIG. 1 shows an example of an apparatus 10 for forming a metal cord 1 consisting of five elementary metal wires.

The device 10 for the production of the metal cord 1 comprises, in a known configuration, a supporting structure 100 to which a rotor 5 is rotatively engaged, the latter being rotated by means of a motor or similar devices (not illustrated in FIG. 1). Furthermore, a cradle (not illustrated in FIG. 1 is connected to said supporting structure and can rock about the rotation axis of rotor 5. Several feeding spools 8 are operatively engaged on the cradle. At least one elementary metal wire of said metal cord 1 is wound on each of the feeding spools 8.

Furthermore, unwinding devices (not illustrated in FIG. 1 because known per se and conventional) are coupled to feeding spools 8, which are fitted on the cradle to guide the elementary metal wires coming from the feeding spools 8.

In a known way, the elementary metal wires at the outlet from the cradle are driven onto rotor 5 according to a predefined stranding path along which the metal cord 1 is formed through the effect of rotation imposed on rotor 5 by means of said motor or equivalent device, in combination with the drive produced on the metal cord 1 by means of collection devices (not illustrated in FIG. 1 since known and not relevant to the scope of the invention).

More in particular, the stranding path comprises a first end section 10*a* essentially coinciding with the rotation axis of rotor 5 and delimited by a first rotating transmission device 12, solidly fastened to rotor 5, and an assembly unit 11 consisting, in a known way, of a plate with five holes, solidly fastened to the cradle and, consequently, stationary.

Along this first end section 10*a* the elementary metal wires are subjected to a first torsion around the rotation axis of rotor 5 through the effect of the rotating pull which the rotor imposes on the first rotating transmission device 12.

Downstream of first rotating transmission device 12, the elementary metal wires follow a central section 10*b* of the stranding path which extends to rotor 5 and is radially spaced from the rotation axis of the rotor so as to skip cradle (not illustrated in FIG. 1) and reach a second transmission device 13 solidly fastened to the rotor 5 on the axially opposite end.

Finally, the stranding path presents a second end section 10*c* substantially coinciding with the rotation axis of rotor 5 and extending beyond second rotating transmission device 13. In this second end section, through the effect of the rotating pull imposed by rotor 5 on second rotating transmission device 13, a second torsion of the elementary wires is performed, thus completing the formation of the metal cord 1 which is progressively pulled away by the aforesaid collection devices.

The ratio between the speed of rotation of rotor 5, preferably of from 2000 rpm to 6000 rpm, and the pulling speed of metal cord 1 and, consequently, of the elementary metal wires which form it, preferably of from 60 m/min to 250 m/min defines the value of the stranding pitch, i.e. the stranding pitch according to which said elementary metal wires are twisted on finished metal cord 1.

Preferably, said stranding pitch is kept at a value of from 2.5 mm to 25 mm, preferably of from 6 mm to 18 mm.

Figure 2A:
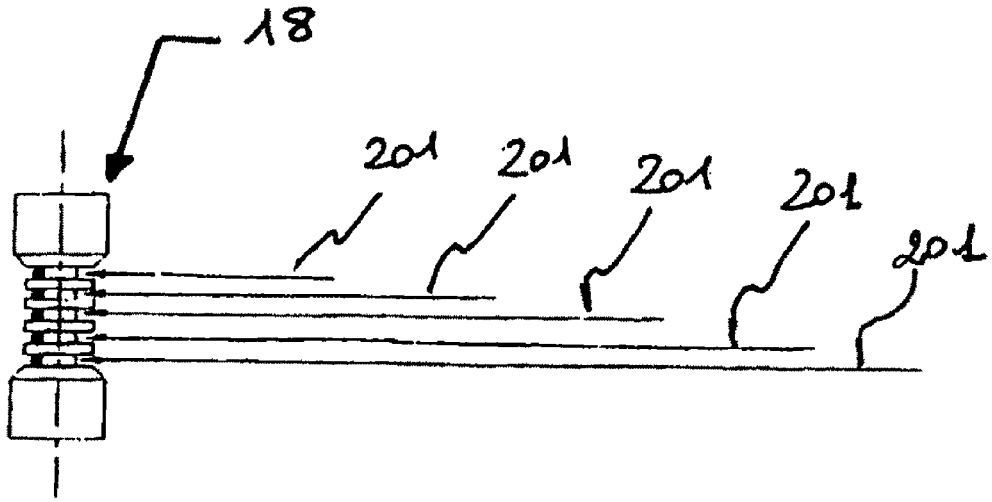
FIGS. 2*a* and 2*b* show in detail a second preforming device according to the present invention, in a partial top view.
Figure 2B:
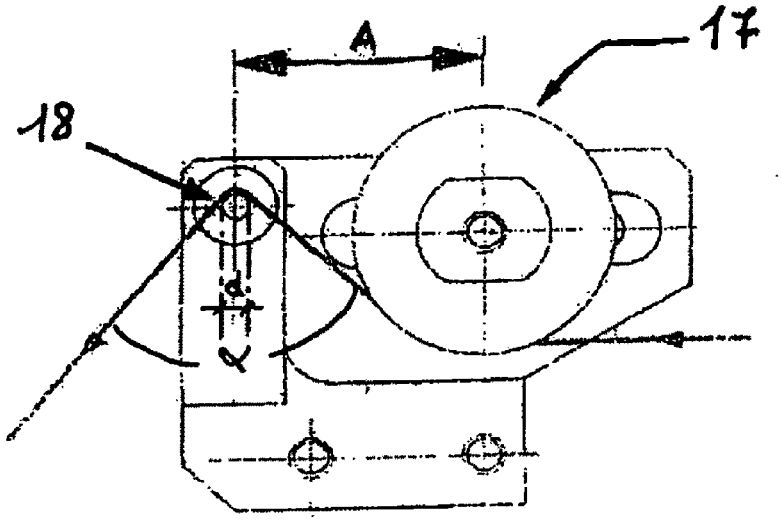

The following elements are operatively arranged in sequence for each elementary metal wire along the path of the elementary metal wires inside the cradle, and more precisely upstream with respect to assembly unit 11: inlet guiding pulleys 14, first preforming devices 15, outlet guiding pulley 16 consisting of a pulley turned at 90° with respect to the pair of pulleys of the first preforming device said turned pulley has the purpose of conveying the elementary metal wires coming out of the first preforming devices 15, to a second preforming device comprising an adjustable pulley 17 and a rotating pin 18 according to the present invention (shown in detail in FIG. 2*a* and in FIG. 2*b*). In FIG. 1, both at the exit of the outlet guiding pulley 16 and of the adjustable pulley 17, the five elementary metal wires coming from the first preforming device 15 and the adjustable pulley 17 respectively, are represented, for simplicity, by means of a single line.

At the exit of the rotating pin 18, the elementary metal wires are conveyed to the assembly unit 11. Optionally, a second outlet guiding pulley may be present between the rotating pin 18 and the assembly device 11 (not represented in FIG. 1).

A detailed description of the first preforming device may be found in U.S. Pat. No. 6,698,179 above disclosed.

FIG. 2*a* shows a partial top view of a rotating pin 18 of the second preforming device according to the present invention comprising a plurality of grooves. The reference sign 201 indicate the five elementary metal wires coming from the adjustable pulley 17. Said rotating pin is preferably of steel.

FIG. 2*b* shows a partial top view of the second preforming device according to the present invention comprising an adjustable pulley 17 and a rotating pin 18, wherein A represents the distance between the central axis of the adjustable pulley 17 and the central axis of rotating pin 18, said distance being preferably of from 5 mm to 50 mm, d represents the diameter, in a cross-section, of the rotating pin 18, said diameter being preferably of from 1 mm to 10 mm, and ($\alpha$) represents the internal angle formed by the rotating pin inlet elementary metal wire and the rotating pin outlet elementary metal wire. Varying both the distance A, the diameter d, and the internal angle ($\alpha$), it is possible to obtain elementary metal wires having different pitch and wave amplitude. Also in FIG. 2*b*, the five elementary metal wires coming from both the outlet guiding pulley 16 (not represented in FIG. 2*b*) and from the adjustable pulley 17, are represented, for simplicity, by means of a single line.

Finally, the device 10 comprises a stretching device (capstan), a device for collecting the produced metal cord and the usual elementary metal wire straightening devices, such as the false twister, to eliminate residual tension in the finished metal cord. These devices are not illustrated in FIG. 1 since known, conventional and not particularly relevant for the purposes of the present invention.

The first and the second preforming devices according to the present invention may be applied to all types of known stranding systems, for example a double twist system or an arrangement system. More in particular, a double twist system may present internal collection (if the collection spool of the finished product is inside of the cradle, between the rotors) or external collection (if the feeding spools are inside of the cradle while the collection spool of the finished product is outside the cradle). The arrangement system, finally, differentiates from the double twist system as in arrangement machines each rotor turn corresponds to a single stranding pitch while in double twist machines each turn of the rotors corresponds to an advancement equal to two stranding pitches. Consequently, the difference between these two systems lies in their productivity.

As already reported above, the elementary metal wire has, preferably, a wavelength (or pitch) of from 1.0 mm to 15 mm, more preferably of from 2.0 mm to 8.0 mm, and a wave amplitude of from 0.10 mm to 1.0 mm, more preferably of from 0.20 mm to 0.50 mm.

Figure 3:
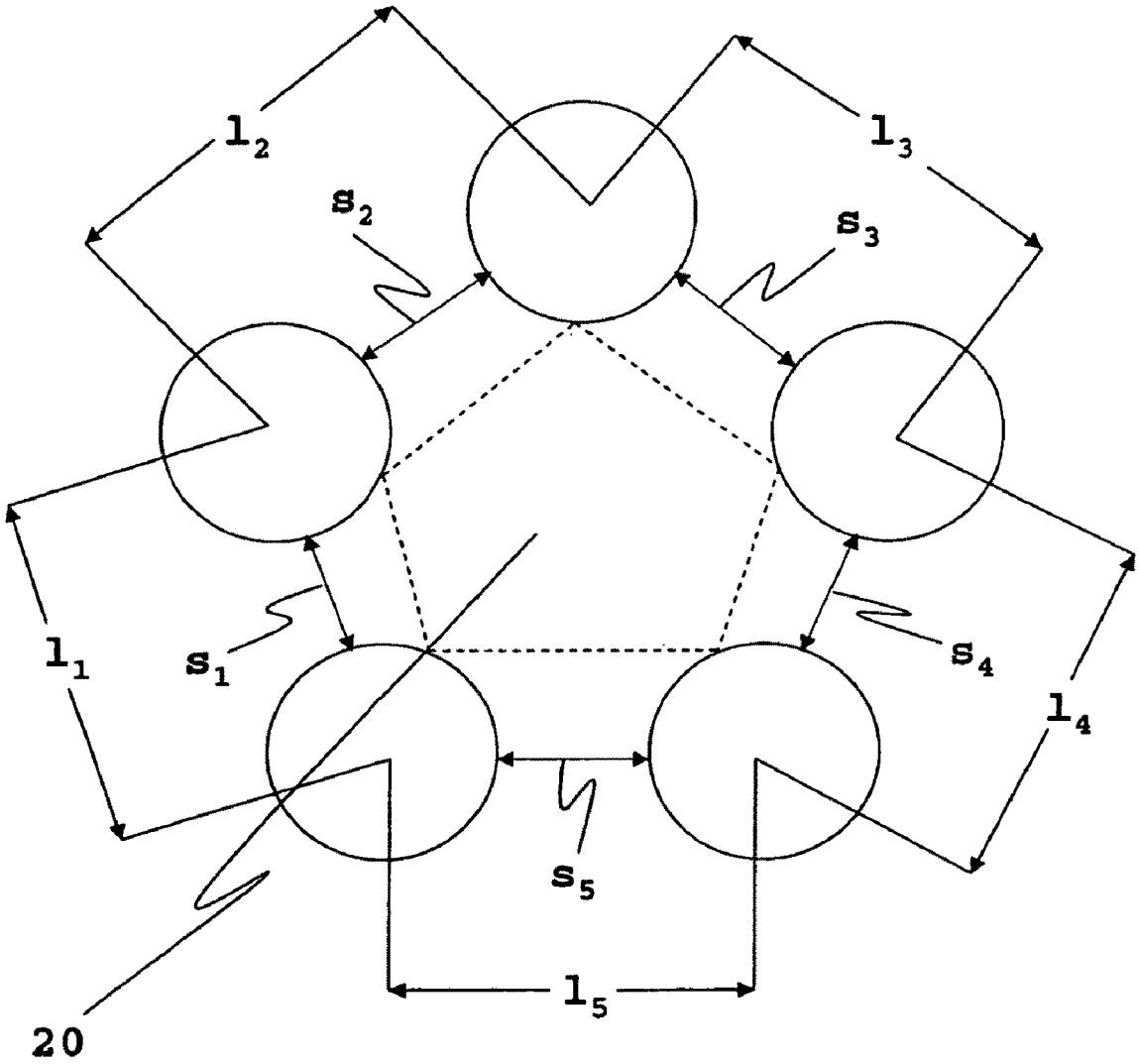
FIG. 3 shows a metal cord in cross-section according to one embodiment of the present invention.

FIG. 3 shows a cross-section of a metal cord of the following type 5×0.25 (i.e., five elementary metal wires having 0.25 mm of diameter stranded together to form a metal cord), wherein $l_1$, $l_2$, $l_3$, $l_4$ and $l_5$ are the distance between the centres of two adjacent elementary metal wire in a cross-section, $s_1$, $s_2$, $s_3$, $s_4$ and $s_5$ are the distance between each couple of adjacent elementary metal wires in a cross-section, 20 is the gap area. In the particular embodiment illustrated in FIG. 4 all the elementary metal wires have the same diameter D (not represented in FIG. 3).

Figure 4:
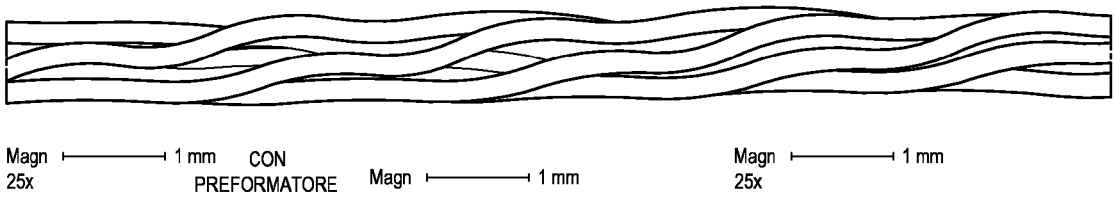
FIG. 4 shows a top view of a metal cord according to the present invention.

FIG. 4 shows a top view of a particular embodiment of a metal cord comprising five double-preformed elementary metal wires.

The present invention will be further illustrated below by means of a number of illustrative embodiments, which are given for purely indicative purposes and without any limitation of this invention.

EXAMPLES 1-3

Three different steel cords having the following characteristics were tested.

Example 1

5×0.25 steel cord wherein all the five elementary steel wires have been double-preformed according to the present invention;

Example 2 (Comparative)

5×0.25 steel "open" cord (OC);

Example 3 (Comparative)

3×3×0.20 high elongation HE HT steel cord.

The breaking load, the elongation at break, and the part load elongation (PLE) at 50 N were measured both on bare steel cord and on rubberized/vulcanized cord (namely, the steel cord which was previously embedded in the elastomeric material and subjected to vulcanization according to methods known in the art). Said measurements were carried out according to method BISFA as disclosed above and the obtained data were given in Table 1.

The part load elongation (PLE) at 50 N is defined as the increase in length of the steel cord, which results from subjecting the steel cord to a defined force of 50 N and is expressed as a percentage of the initial length of the steel cord under a defined pre-tension (for example, 2.5 N).

In particular, in the case of rubberized/vulcanized steel cord, a strip of rubberized fabric reinforced with steel cords arranged to have a density equal to 100 cords/dm was used.

TABLE 1

| | EXAMPLE 1 | EXAMPLE 2[a] | EXAMPLE 3[a] | EXAMPLE 1 | EXAMPLE 2[a] | EXAMPLE 3[a] |
|---|---|---|---|---|---|---|
| | BARE CORD | | | RUBBERIZED/VULCANIZED CORD | | |
| Stranding Pitch (mm) | 12.5 S | 10 S | 3.15/6.3 S/S | 12.5 S | 10 S | 3.15/6.3 S/S |
| Breaking load[*] (N) | 602 | 698 | 780 | 598 | 703 | 790 |
| Elongation at break[*] (MPa) | 4.25 | 2.49 | 3.55 | 4.15 | 1.50 | 3.00 |
| Part load elongation (PLE) at 50 N (%)[**] | 0.557 | 0.492 | 1.155 | 0.552 | 0.256 | 0.967 |

[a]comparative;
[*]method BISFA E6;
[**]method BISFA E7.

By analysing the data reported in Table 1, it appears that the steel cord according to the present invention (Example 1) shows both high elongation at break and high part load elongation (PLE) and that said characteristics are maintained even in the rubberized/vulcanized cord.

EXAMPLES 4-5

Two different steel cords having the following characteristics were tested.

Example 4

5×0.25-steel cord wherein all the five elementary steel wires have been double-preformed according to the present invention;

Example 5 (Comparative)

5×0.25 steel cord of the coplanar type obtained according to the process disclosed in the abovementioned U.S. Pat. No. 6,698,179.

The breaking load, the elongation at break, and the part load elongation (PLE) were measured on bare steel cord: the measurements were carried out according to method BISFA as disclosed above and the obtained data were given in Table 2.

Figure 5:
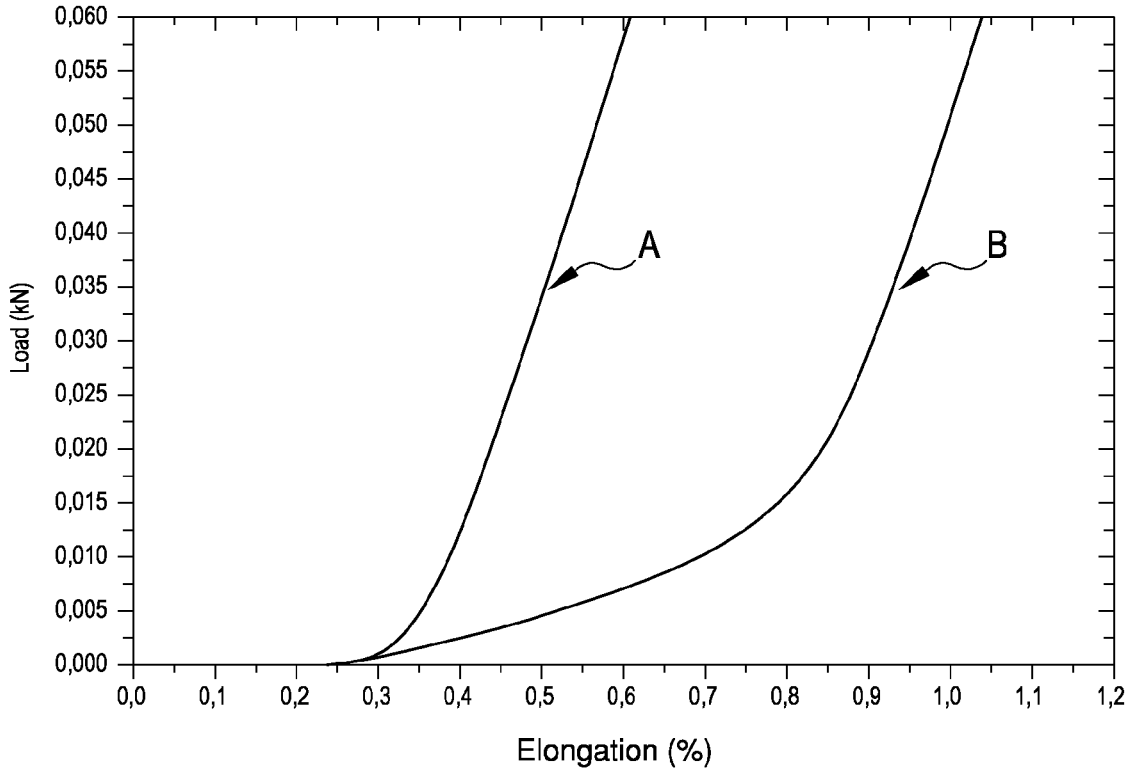
FIG. 5 shows a part load elongation (PLE) of different metal cords.

The part load elongation (PLE) values were also reported in FIG. 5 wherein in the y axis a load (expressed in kN) was reported as in the x axis the elongation (%) was reported. In FIG. 5 curve A corresponds to Example 5 (comparative) as curve B corresponds to Example 4 according to the present invention.

Moreover, the above reported steel cords, were subjected to rubber penetration test which consists in measuring the penetration degree of the elastomeric material, after the rubberization process, between the steel wires forming said cord and in identifying, as a consequence, the quality of the elastomeric coating around each of said steel wires. A funnel advantageously made of glass was reversed on the bottom of a bowl containing ethyl alcohol. This funnel presented a scale along the cylindrical stem and ended, on the free end of this stem, with a suction device generally worked by the operator. The operation of the suction device caused the ethyl alcohol to rise in the cylindrical stem to reach a predefined level, called zero level. In this phase, the sample to be examined, consisting of a strip of the type described above with dimensions equal to 5 cm×5 cm, was submerged in the bowl and positioned at the inlet of the funnel. Ethyl alcohol has the property of expelling the air which may be contained in the elastomeric material and to take its place. This fact caused a decrease with respect to the aforesaid zero level of the level of ethyl alcohol in the scaled stem. This measurement allowed to define the volume of air possessed by the elastomeric material in which the steel wires are embedded and, consequently, the penetration degree of the rubber between the steel wires forming the steel cord.

TABLE 2

| | EXAMPLE 4 | EXAMPLE 5[a] |
|---|---|---|
| Stranding Pitch (mm) | 12.5 S | 12.5 S |
| Breaking load[*] (N) | 596 | 558 |
| Elongation at break[*] (MPa) | 4.20 | 4.04 |
| Part load elongation (PLE) at 50 N (%)[**] | 0.605 | 0.240 |
| Rubber penetration ($mm^3$/cm of cord) | 0.28 | 0.10 |

[a]comparative;
[*]method BISFA E6;
[**]method BISFA E7.

By analysing the data reported in Table 2, it appears that the steel cord according to the present invention (Example 4) shows improved mechanical characteristics (in particular, a part load elongation—see also FIG. 5) with respect to the steel cord of the prior art (Example 5). Moreover the steel cord according to the present invention (Example 4) shows an improved rubber penetration with respect to the steel cord of the prior art (Example 5).

Example 6

A 5×0.25 steel cord, having a stranding pitch (mm) of 12.5 S, wherein all the five elementary steel wires have been double-preformed according to the present invention, was subjected to the measurement of both the gap area (G.A.) and the sum of the distance between each couple of adjacent metal wires in a cross-section ($\Sigma s_n$).

To this aim, three different portions (A to C) were randomly made along the longitudinal development of the steel cord (each portion having a length corresponding to three stranding pitches). In their turn, each portion was subjected to five cross-sections (in particular, one stranding pitch of each portion was subjected to five cross-sections, said cross-sections having all the same length) and the above reported measurements were made for each cross-section. The measurements were made by using a magnifying lens and a graduated ruler: the obtained data are given in Table 3.

TABLE 3

| A | B | C |
|---|---|---|
| (G.A.) = 0.325<br>$(\Sigma s_i) = 1.0 \times \pi d^2/4$ | (G.A.) = 0.950<br>$(\Sigma s_i) = 3.0 \times \pi d^2/4$ | (G.A.) = 0.525<br>$(\Sigma s_i) = 2.0 \times \pi d^2/4$ |

TABLE 3-continued

| A | B | C |
|---|---|---|
| (G.A.) = 0.900<br>$(\Sigma s_i) = 2.0 \times \pi d^2/4$ | (G.A.) = 0.650<br>$(\Sigma s_i) = 2.0 \times \pi d^2/4$ | (G.A.) = 0.450<br>$(\Sigma s_i) = 1.5 \times \pi d^2/4$ |
| (G.A.) = 0.755<br>$(\Sigma s_i) = 2.0 \times \pi d^2/4$ | (G.A.) = 0.325<br>$(\Sigma s_i) = 1.5 \times \pi d^2/4$ | (G.A.) = 0.450<br>$(\Sigma s_i) = 1.5 \times \pi d^2/4$ |
| (G.A.) = 0.200<br>$(\Sigma s_i) = 1.0 \times \pi d^2/4$ | (G.A.) = 0.450<br>$(\Sigma s_i) = 1.5 \times \pi d^2/4$ | (G.A.) = 0.675<br>$(\Sigma s_i) = 2.0 \times \pi d^2/4$ |
| (G.A.) = 0.625<br>$(\Sigma s_i) = 2.0 \times \pi d^2/4$ | (G.A.) = 0.450<br>$(\Sigma s_i) = 1.5 \times \pi d^2/4$ | (G.A.) = 0.650<br>$(\Sigma s_i) = 2.0 \times \pi d^2/4$ |

By analyzing the data reported in Table 3, it appears that the steel cord according to the present invention maintains the above reported characteristics, i.e. the gap area (G.A.) and the sum of the distance between each couple of adjacent metal wires in a cross-section ($\Sigma s_n$), along its entire longitudinal development.

The invention claimed is:

1. A metal cord comprising at least one preformed elementary metal wire, comprising:

an elongation at break, measured on a bare cord, higher than or equal to 3%;

an elongation at break, measured on a rubberized and vulcanized cord, which differs in an amount not higher than or equal to 15% with respect to the elongation at break measured on the bare cord;

a part load elongation, measured on the bare cord, higher than or equal to 0.4%; and a part load elongation, measured on the rubberized and vulcanized cord, which differs in an amount not higher than or equal to 15% with respect to the part load elongation measured on the bare cord.

2. The metal cord according to claim 1, wherein said metal cord has an elongation at break, measured on the bare cord, of 4% to 6%.

3. The metal cord according to claim 1, wherein said metal cord has an elongation at break, measured on the rubberized and vulcanized cord, which differs in an amount of 2% to 10% with respect to the elongation at break measured on the bare cord.

4. The metal cord according to claim 1, wherein said metal cord has a part load elongation, measured on the bare cord, of 0.5% to 1.5%.

5. The metal cord according to claim 1, wherein said metal cord has a part load elongation, measured on the rubberized and vulcanized cord, which differs in an amount of 0.5% to 10%, with respect to the part load elongation measured on the bare cord.

6. The metal cord according to claim 1, wherein said metal cord consists of a plurality of elementary preformed metal wires.

7. The metal cord according to claim 1, comprising at least one preformed elementary metal wire, while remaining elementary metal wires forming said metal cord are of the non-preformed type.

8. The metal cord according to claim 1, wherein said elementary metal wire is first preformed so that it assumes substantially sinusoidal undulations; and secondly, said first preformed elementary metal wire is helicoidally preformed along its longitudinal axis, so that it assumes a helical wave-shaped configuration.

9. The metal cord according to claim 1, wherein said elementary metal wire is tri-dimensionally preformed.

10. The metal cord according to claim 8, wherein said sinusoidal undulations have a wavelength or pitch of 1.0 mm to 15 mm.

11. The metal cord according to claim 10, wherein said sinusoidal undulations have a wavelength or pitch of 2.0 mm to 8.0 mm.

12. The metal cord according to claim 8, wherein said sinusoidal undulations have a wave amplitude of 0.10 mm to 1.0 mm.

13. The metal cord according to claim 12, wherein said sinusoidal undulations have a wave amplitude of 0.20 mm to 0.50 mm.

14. The metal cord according to claim 1, wherein said elementary metal wire has a diameter of 0.10 mm to 0.50 mm.

15. The metal cord according to claim 14, wherein said elementary metal wire has a diameter of 0.12 mm to 0.40 mm.

16. The metal cord according to claim 1, wherein said elementary metal wire of steel.

17. The metal cord according to claim 1, wherein said elementary metal wire comprises a coating based on zinc, zinc/manganese alloys, zinc/cobalt alloys or zinc/cobalt/manganese alloys.

18. The metal cord according to claim 1, wherein said metal cord comprises 2 to 6 elementary metal wires.

19. The metal cord according to claim 18, wherein said metal cord consists of 5 elementary metal wires.

20. The metal cord according to claim 1, wherein said metal cord has a stranding pitch of 2.5 mm to 25 mm.

21. The metal cord according to claim 20, wherein said stranding pitch is 6 mm to 18 mm.

22. The metal cord according to claim 1, comprising the following characteristics:

a gap area which fulfills the following equation:

wherein D is the elementary metal wire diameter; and the sum of the distances between each couple of adjacent elementary metal wires in a cross-section ($\Sigma s_n$) which fulfills the following equation:

$$(\Sigma s_n) > D/2$$

wherein n is the number of the elementary metal wires, and D is the elementary metal wire diameter; said characteristics being maintained along the entire longitudinal development of the metal cord.

23. A process for manufacturing a metal cord comprising the steps of:

(a) permanently deforming at least one elementary metal wire according to a substantially sinusoidal deformation lying in a plane obtaining a preformed metal wire;

(b) permanently deforming the preformed elementary metal wire obtained in step (a) in a helicolidal way along its longitudinal axis, so obtaining a double-preformed elementary metal wire; and (c) stranding the at least one double-preformed elementary metal wire obtained in step (b) with at least one additional elementary metal wire by twisting, thus obtaining the metal cord.

24. An apparatus for manufacturing a metal cord comprising:

at least one rotor engaged to a supporting structure and rotatable according to a rotation axis;

feeding devices to feed a plurality of elementary metal wires from respective feeding spools, said elementary metal wires being driven onto the rotor according to a stranding path with end sections coinciding with a rotation axis of said rotor and with a central section spaced from said rotation axis;

at least one first preforming device, positioned in a section upstream with respect to the first end section of the stranding path, operating on one of said elementary metal wires, said at least one first preforming devices providing said elementary metal wire with a substantially sinusoidal permanent deformation; and at least one second preforming device, positioned after said first preforming device in a section upstream with respect to the first end section of the stranding path, operating on the same elementary metal wire, said at least one second preforming device providing said elementary metal wire with a substantially helicoidal permanent deformation along its longitudinal axis.

25. The apparatus for manufacturing a metal cord according to claim 24, wherein said apparatus comprises at least one first preforming device for each elementary metal wire of the metal cord.

26. The apparatus for manufacturing a metal cord according to claim 24, wherein said at least one first preforming device comprises a first and a second pulley, each pulley having a plurality of circumferentially arranged pins, said pulleys being positioned at a distance so that during rotation the pins of the first and the second pulleys interpenetrate so as to induce a substantially sinusoidal deformation without sharp edges on a wire passing through the space between the pins of the first pulley and the corresponding pins of the second pulley.

27. The apparatus for manufacturing a metal cord according to claim 24, wherein said at least one second preforming device comprises a pulley and a rotating pin, said roating pin being positioned between said pulley and the first end section of the stranding path in such a way that, the internal angle formed by the rotating pin inlet elementary metal wire and the rotating pin outlet elementary metal wire is lower than or equal to 180°.

28. The apparatus for manufacturing a metal cord according to claim 27, wherein said internal angle formed by the rotating pin inlet elementary metal wire and the rotating pin outlet elementary metal wire is 45° to 90°.

29. The apparatus for manufacturing a metal cord according to claim 24, comprising at least one second preforming device for each elementary metal wire.

* * * * *

UNITED STATES PATENT AND TRADEMARK OFFICE

CERTIFICATE OF CORRECTION

PATENT NO. : 7,975,463 B2
APPLICATION NO. : 12/226975
DATED : July 12, 2011
INVENTOR(S) : Fabrizio Cristofani et al.

It is certified that error appears in the above-identified patent and that said Letters Patent is hereby corrected as shown below:

In claim 16, column 13, line 15, "wire of steel" should read --wire is steel--.

In claim 22, column 13, line 30, after "following equation:", insert --Gap Area $\geq \pi D^2/4$--.

Signed and Sealed this
First Day of January, 2013

David J. Kappos

David J. Kappos
*Director of the United States Patent and Trademark Office*